US007990353B2

(12) United States Patent
Chow

(10) Patent No.: US 7,990,353 B2
(45) Date of Patent: Aug. 2, 2011

(54) METHOD AND APPARATUS FOR REDUCING THE VISUAL EFFECTS OF NONUNIFORMITIES IN DISPLAY SYSTEMS

(75) Inventor: Wing Hong Chow, Sunnyvale, CA (US)

(73) Assignee: Jasper Display Corp., Hsinchu (TW)

( * ) Notice: Subject to any disclaimer, the term of this patent is extended or adjusted under 35 U.S.C. 154(b) by 1320 days.

(21) Appl. No.: 11/532,869

(22) Filed: Sep. 18, 2006

(65) Prior Publication Data

US 2007/0030228 A1 Feb. 8, 2007

Related U.S. Application Data

(63) Continuation of application No. 10/441,474, filed on May 19, 2003, now Pat. No. 7,129,920.

(60) Provisional application No. 60/381,349, filed on May 17, 2002.

(51) Int. Cl.
*G09G 3/36* (2006.01)

(52) U.S. Cl. ..... 345/89; 345/690; 345/87; 345/88

(58) Field of Classification Search ..... 345/690, 345/87–89

See application file for complete search history.

(56) References Cited

U.S. PATENT DOCUMENTS 4,825,201 A * 4/1989 Watanabe et al. ..... 345/2.1
5,359,342 A 10/1994 Nakai et al.
5,473,338 A 12/1995 Prince et al.
6,603,452 B1 * 8/2003 Serita ..... 345/88
2002/0024481 A1 * 2/2002 Kawabe et al. ..... 345/87
2003/0210257 A1 11/2003 Hudson et al.

FOREIGN PATENT DOCUMENTS

JP 2002-116741 A * 4/2002

OTHER PUBLICATIONS

E.G. Colgan et al., "On-Chip Metallization Layers for Reflective Light Waves", Journal of Research Development, vol. 42, No. 3/4, May/Jul. 1998.

www.westar.com/mdis, Product Description, "Westar's Microdisplay Inspection System," Westar Corporation, Jan. 2000.

* cited by examiner

*Primary Examiner* — Richard Hjerpe
*Assistant Examiner* — Leonid Shapiro
(74) *Attorney, Agent, or Firm* — Kusner & Jaffe

(57) ABSTRACT

A method is provided for compensating for output nonuniformity on a display. The method comprises characterizing the display. The method further includes creating a set of data tables wherein one table provides data for compensation along vertical axes of the display and a second table provided data for compensation along horizontal axes of the display, and wherein components of the tables include a linear offset factor to correct data for nonuniformity and a slope factor which permits gray scale information to be recovered at points near the limits of the gray scale range. The characterizing step may include using a optical detector to obtain optical output information from the display. The slope factor may be calculated to preserve top end gray scale range of the display by adjusting luminous output so that input data level maps to separate output grey levels between a truncated and an untruncated level.

22 Claims, 7 Drawing Sheets

*Horizontal Table*

| | | | |
|---|---|---|---|
| *H(Ofst 1-1, Slp 1-1)* | *H(Ofst 1-2, Slp 1-2)* | *H(Ofst 1-3, Slp 1-3)* | *..H(Ofst 1-y, Slp 1-y)* |
| *H(Ofst 2-1, Slp 2-1)* | *H(Ofst 2-2, Slp 2-2)* | *H(Ofst 2-3, Slp 2-3)* | *..H(Ofst 2-y, Slp 2-y)* |
| *H(Ofst 3-1, Slp 3-1)* | *H(Ofst 3-2, Slp 3-2)* | *H(Ofst 3-3, Slp 3-3)* | *..H(Ofst 3-y, Slp 3-y)* |
| ... | ... | ... | ... |
| *H(Ofst x-1, Slp x-1)* | *H(Ofst x-2, Slp x-2)* | *H(Ofst x-3, Slp x-3)* | *..H(Ofst x-y, Slp x-y)* |

*Vertical Table*

| | | | |
|---|---|---|---|
| *V(Ofst 1-1, Slp 1-1)* | *V(Ofst 1-2, Slp 1-2)* | *V(Ofst 1-3, Slp 1-3)* | *..V(Ofst 1-y, Slp 1-y)* |
| *V(Ofst 2-1, Slp 2-1)* | *V(Ofst 2-2, Slp 2-2)* | *V(Ofst 2-3, Slp 2-3)* | *..V(Ofst 2-y, Slp 2-y)* |
| *V(Ofst 3-1, Slp 3-1)* | *V(Ofst 3-2, Slp 3-2)* | *V(Ofst 3-3, Slp 3-3)* | *..V(Ofst 3-y, Slp 3-y)* |
| ... | ... | ... | ... |
| *V(Ofst x-1, Slp x-1)* | *V(Ofst x-2, Slp x-2)* | *V(Ofst x-3, Slp x-3)* | *..V(Ofst x-y, Slp x-y)* |

FIG. 6

METHOD AND APPARATUS FOR REDUCING THE VISUAL EFFECTS OF NONUNIFORMITIES IN DISPLAY SYSTEMS

The present application is a continuation of U.S. patent application Ser. No. 10/441,474, filed May 19, 2003 now U.S. Pat. No. 7,129,920 which claims the benefit of priority to U.S. Provisional Patent Application Ser. No. 60/381,349 filed May 17, 2002. All applications listed above are incorporated herein by reference for all purposes.

BACKGROUND OF THE INVENTION

1. Technical Field of the Invention

This invention relates to methods and techniques for reducing the visual impact of cell gap and drive voltage nonuniformities in liquid crystal displays, and more particularly to projection and other magnified displays based on liquid crystal on silicon microdisplays.

2. Discussion of Related Art

Liquid crystal displays and more particularly liquid crystal on silicon microdisplays are very sensitive to variations in cell gap thickness, pretilt and drive voltage. The effects of these variations can be observed as differences of intensity seen in regions where such differences are noticeable. These same phenomena exist in all liquid crystal displays but often the distance over which the nonuniformities are manifested are quite small compared to the overall display. Additionally there are methods available to solve this problem that are not suitable in the microdisplay environment.

The present problem is the one of nonuniformities in microdisplays used in displays that magnify the images created by the microdisplays. Nonuniformities within the display are magnified in the same way that the images themselves are magnified. The nonuniformities typically manifest themselves over a range of 50 to several hundred pixel elements and thus are visible but relatively slow changing phenomena.

In flat panel displays the problem of variations in cell gap is shown in FIG. 1. The cell gap problem may be addressed by using spacer balls or spacer rods in the active area of the display (see FIGS. 2*a* and 2*b*). These spacers place a minimum bound on the spacing between the two substrates that keeps the distance relatively uniform over the very large area, often on the order of 11 inches diagonal or more, of the display.

Spacers are undesirable in certain display applications and have proved problematic in liquid crystal on silicon display. The use of random spacer balls has been evaluated at great length and found to be unacceptable. Randomly placed spacer balls block the primary color at that point on the microdisplay, invariably create small spots in the projected image where the remaining two of the three primary colors are displayed. The spots show as areas where complementary colors are visible within fields of otherwise white light. While this problem exists to a small degree in direct view panels, the effects are normally negligible, whereas the effects in the magnified images of projection displays become objectionable and threaten the commercial success of the product.

Several solutions exist. It is possible to align all the spacer posts by building them into the backplane. This is not a complete solution because the three microdisplays are normally aligned using a combination of mechanical alignment and electronic image convergence. Alternatively the microdisplays can be constructed without the use of spacers of any type. While preferable, this leads back to the fundamental problem of uniformity across the aperture of the display device. An analysis of the visible effects of these nonuniformities is in order.

These nonuniformities normally arise as part of the manufacturing processes used for these displays. For example, in liquid crystal on silicon microdisplays the surface of the microdisplay is rendered local flat and optically reflective by a process called chemical-mechanical polishing, or CMP. It is well know that CMP sometime results in a differential ablating of the original surface material. While the resulting surface is much better than the original surface it still is not as flat as a piece of highly polished glass. Local variations result in a surface which, when integrated into a display, results in perhaps a 5% variance in the thickness of the liquid crystal layer that is being driven so as to modulate light.

Other sources of variance include a nonuniform rubbing to create alignment of the liquid crystal. In such cases a slight change in rubbing density due to surface topology can create a slight difference to the liquid crystal pretilt which in turn can change the effective birefringence of that part of the cell and thus result in a nonuniformity in the cell.

An additional source of variance is the delivery of nonuniform voltages to the pixel electrodes associated with a image. This can result from a variety of factors. Common causes include improper or nonuniform line impedance matching, use of low cost CMOS digital to analog converters without calibration, and lack of uniform and consistent pixel capacitor size in DRAM based microdisplays manufactured in CMOS processes.

In the case of an SRAM based display the liquid crystal display is modulated by pulse width modulation because the logic cell selects a high state or a low state. In practice in the example of a normally black mode twisted nematic liquid crystal device, there are two "low" states that are close to the voltage of the common electrode and two "high" states that are further away from the voltage of the common electrode. It is desirable when driving nematic liquid crystals that these be mirror images of each other and that the alternation take place at a relatively high rate. If two pixel electrodes are driven by the same set of pulse width modulated data then the RMS voltage associated with the two pixel electrodes will be identical. If the cell gaps associated with the two pixel electrodes differ from each other by some margin, say 5%, then there will be a corresponding difference in the field strength across the pixel gap as a function of distance. As a result, the pixel electrode associated with the greater of the two cell gaps will need to see a higher RMS voltage in order to achieve the same level of birefringence in the associated liquid crystal as is seen in the liquid crystal associated with the pixel electrode associated with the lesser cell gap. This greater RMS voltage can be achieved only by driving the pixels electrode for a greater period of time with the "high" state voltages.

The impact of all these variations on the optical throughput of a given microdisplay can be quite pronounced. For example, in liquid crystal on silicon displays using the twisted nematic electro-optic effect an increase in the thickness of the cell results in a smaller change in the optical state of the liquid crystal relative to adjacent regions in the same device where the cell gap is slightly lower. An analysis of the voltage transfer curves of the two regions, where optical throughput is plotted as a function of the drive voltage across the cell, reveals similar but not identical curves. In both cases the effective gray scale region in the thicker cell demonstrates a need for high voltages to achieve full optical efficiency when compared with the curve for the thinner cell.

Measuring the effects of these nonuniformities across the pixel array of the microdisplay requires an instrumentation device that can collect segments of the voltage transfer curve as a function of position on the display. Any number of devices can be devised to collect this data. One commercially available automated device that is particularly well suited to this task is the MicroDisplay Inspection System (MDIS) recently developed by Westar Corporation of St. Louis, Mo. This capability is described in a set of brochures downloaded from their website http://www.displaytest.com/mdis/detailed.html on Apr. 30, 2002.

SUMMARY OF THE INVENTION

Accordingly, an object of the present invention is to provide improved nonuniformity compensation systems, and their methods of use.

Another object of the present invention is to provide improved methods for adjusting optical output from displays which increase the yield from current display manufacturing processes.

Yet another object of the present invention is to provide improved controllers and their methods of use, that provide the improved nonuniformity compensation scheme.

Still a further object of the present invention is to provide a display system, and the methods of its use, that include this improved nonuniformity compensation scheme.

At least some of these objects are achieved by some embodiments of the present invention.

In one aspect of the present invention, a method is provided for compensating for output nonuniformity on a display. The method comprises characterizing the display. The method further includes creating a set of data tables wherein one table provides data for compensation along vertical axes of the display and a second table provided data for compensation along horizontal axes of the display, and wherein components of the tables include a linear offset factor to correct data for nonuniformity and a slope factor which permits gray scale information to be recovered at points near the limits of the gray scale range. The characterizing step may include using a optical detector to obtain optical output information from the display. The slope factor may be calculated to preserve top end gray scale range of the display by adjusting luminous output so that input data level maps to separate output grey levels between a truncated and an untruncated level.

In another embodiment of the present invention, a method is provided for reducing visual impact of cell gap and drive voltage nonuniformities on a liquid crystal display. The method comprises correcting luminous output at a given point on the display by making a weighted interpolation between horizontal correction factors for a cell and vertical correction factors for the same cell and averaging the two correction factors. The method further includes applying an averaged correction factor to adjust voltage to the display.

In a still further embodiment of the present invention, a method is provided for compensating for nonuniformity in a display. The method comprises scaling input to display at native resolution; performing nonuniformity correction based on horizontal and vertical nonuniformity correction databases to create nonuniformity corrected data; apply gamma correction; separating gamma corrected data into bit planes; and applying bit planes to the display.

In a still further embodiment of the present invention, a method is provided comprising providing a display with output nonuniformity. The method also includes providing a database with horizontal correction factors for a cell on the display and vertical correction factors for the same cell, the correction factors having at least one correction for voltage and one correction for gray scale truncation.

In another aspect of the present invention, a display is provided comprising a plurality of pixels and a controller. The controller may have logic for correcting for cell gap variation at a given point on the display by adjusting image data to the display, the adjusting based on a weighted interpolation between horizontal correction factors for a cell on the display and vertical correction factors for the same cell and averaging the two correction factors, wherein data to each pixel in the cell is adjusted based on pixel location in the cell.

Another aspect of the invention is a means of modifying the drive voltage delivered to individual pixels in order to make the electro-optic performance of the display more uniform. This method is an alternative to providing different drive rail voltages to the display pixels and is compatible with analog gray scale methodologies as well as pulse width modulation gray scale methodologies.

A further understanding of the nature and advantages of the invention will become apparent by reference to the remaining portions of the specification and drawings.

BRIEF DESCRIPTION OF THE DRAWINGS

FIG. 6 depicts the structure of the lookup tables for the horizontal correction table.

DESCRIPTION OF THE SPECIFIC EMBODIMENTS

It is to be understood that both the foregoing general description and the following detailed description are exemplary and explanatory only and are not restrictive of the invention, as claimed. It should be noted that, as used in the specification and the appended claims, the singular forms "a", "an" and "the" include plural referents unless the context clearly dictates otherwise. Thus, for example, reference to "a material" may include mixtures of materials, reference to "an LED" may include multiple LEDs, and the like. References cited herein are hereby incorporated by reference in their entirety, except to the extent that they conflict with teachings explicitly set forth in this specification.

In this specification and in the claims which follow, reference will be made to a number of terms which shall be defined to have the following meanings:

"Optional" or "optionally" means that the subsequently described circumstance may or may not occur, so that the description includes instances where the circumstance occurs and instances where it does not. For example, if a device optionally contains a feature for analyzing a blood sample, this means that the analysis feature may or may not be present, and, thus, the description includes structures wherein a device possesses the analysis feature and structures wherein the analysis feature is not present.

The present invention presents techniques that can reduce the visual impact of nonuniformities in images generated using displays such as, but not limited to, liquid crystal on silicon microdisplays and that are compatible with other types of image generators, such as TFT panels and the like.

The present invention may also be compatible with image generation techniques such as that described in previously filed application entitled "MODULATION SCHEME FOR DRIVING LIQUID CRYSTAL ON SILICON DISPLAY SYSTEMS" filed as eLCOS Internal Docket 2002/001 filed May 10, 2002 and commonly assigned, copending U.S. patent application Ser. No. 10/435,427 filed May 9, 2003. All applications listed above are fully incorporated herein by reference for all purposes.

Figure 1:
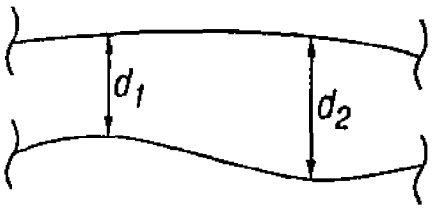
FIG. 1 presents a cross-sectional view of a non-uniform cell gap in a liquid crystal cell.

FIG. 1 depicts an example of a nonuniform cell gap d1 and d2 in a liquid crystal display. The causes of the nonuniformity vary but the effects are identical. An example of the effects will be presented in FIG. 3 below.

Figure 2B:
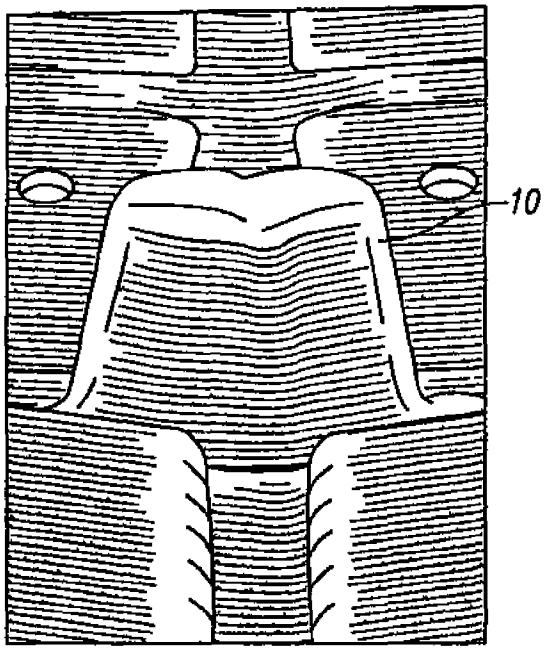
FIG. 2*b* presents an expanded view of a single spacer post.
Figure 2A:
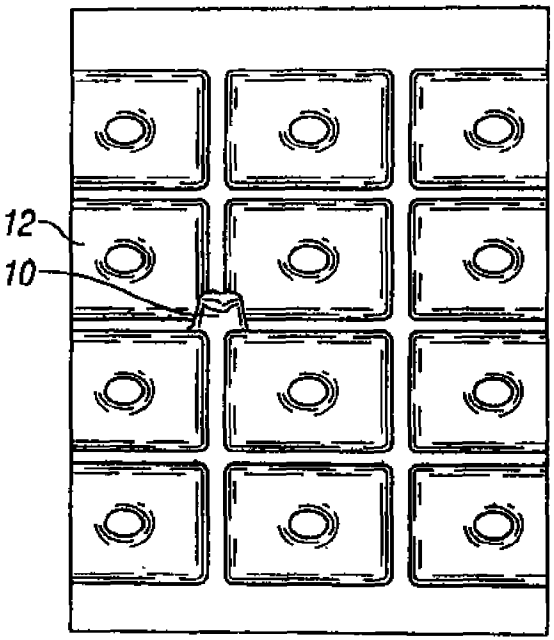
FIG. 2*a* presents a view of a single spacer post in a field of pixels

FIGS. 2*a* and 2*b* present one known fix for cell gap nonuniformity. FIG. 2*a* shows a space post 10 in a field of pixel electrodes 12. The post 10 is typically placed at the corner of four pixels because this minimizes the impact of the post on the aperture ratio of the display. FIG. 2*b* shows the individual spacer post 10 in more detail. The post is wide in relationship to its height to give it a measure of strength that is needed during the process of laminating the cover glass to the silicon side. The figures depicted are based upon "On Chip Metallization Layers for Reflective Light Valves" by E. G. Colgan, et al, IBM Journal of Research and Development, Volume 42, Nos. 3 & 4, May/July 1998, pp. 344.

Figure 3A:
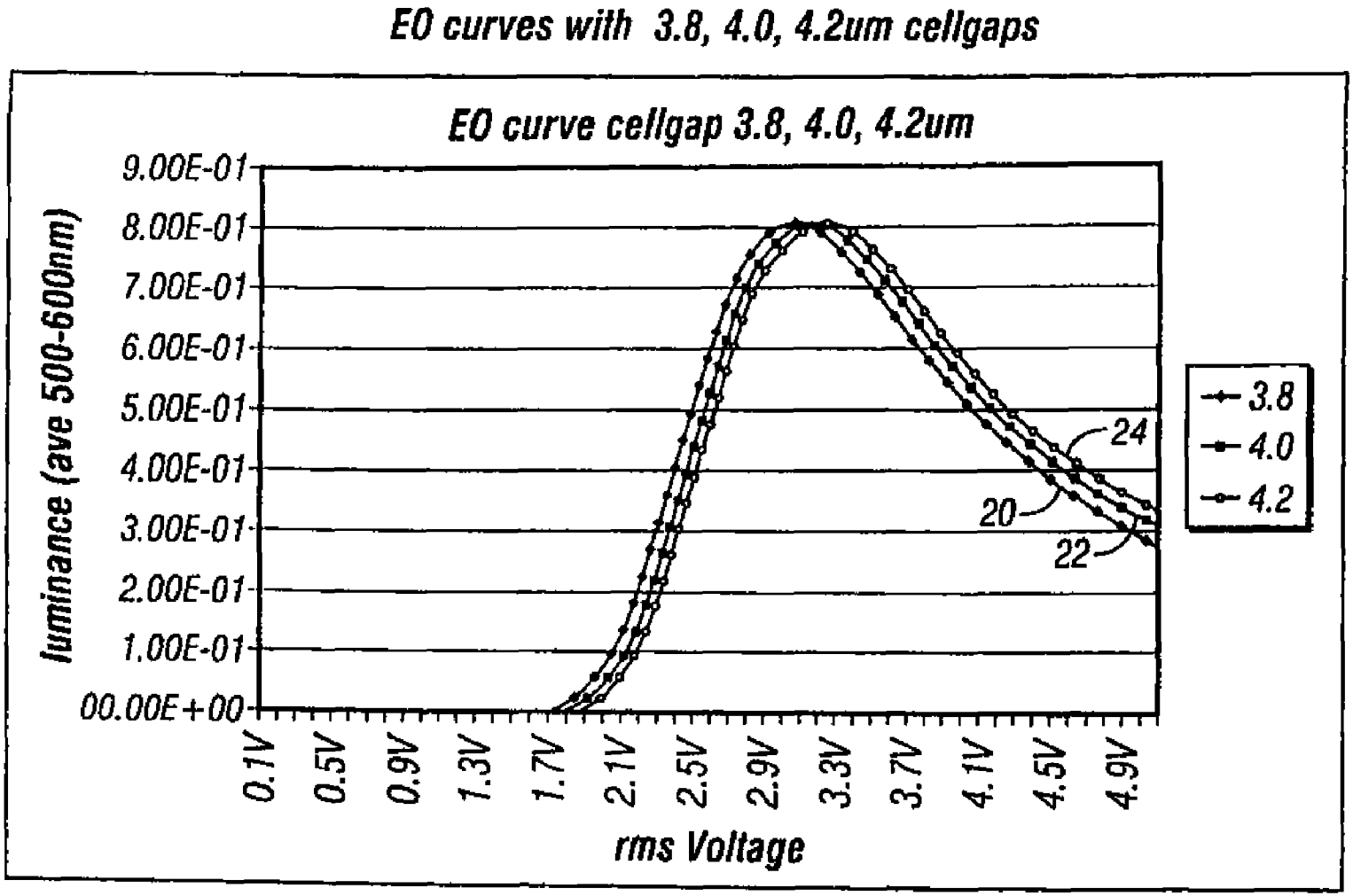
FIG. 3*a* presents a drawing of three overlaid voltage transfer EO curves placed on common voltage and throughput axes representing modeled data for three different cell gaps.
Figure 3B:
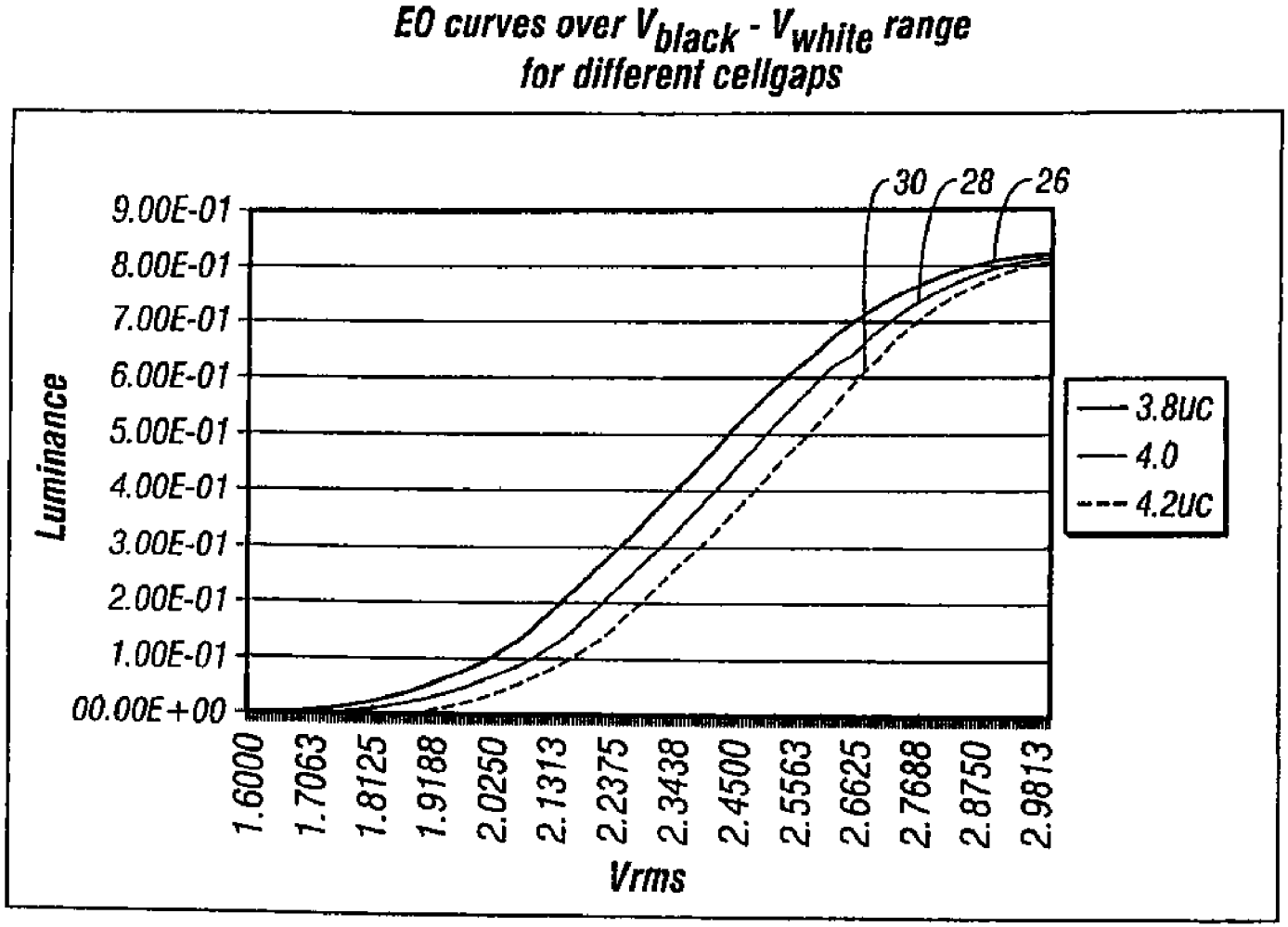
FIG. 3*b* presents a drawing of the same data presented in FIG. 3*a* on an expanded voltage scale.

FIG. 3*a* and FIG. 3*b* present three voltage transfer curves demonstrating the optical efficiency of a reflective microdisplay as a function of voltage. The data presented were calculated using a standard LC simulation program. The voltages attached to these figures in this application should be considered only to be representative of typical LC data and not indicative of the only class of materials to which the present techniques can be applied. FIG. 3*a* depicts data for the entire voltage range of 0 to 5 volts. FIG. 3*b* depicts the same data presented on the reduced voltage scale of 1.6 to 3.0 volts for clarity. The EO effect chosen for the example is a 45 degree twisted nematic effect configured in the normally black mode. However, the same considerations can be applied to any type of nematic liquid crystal mode or, for that matter, to other liquid crystal types, such as surface stabilized ferroelectric liquid crystal (SS-FLC) devices. The data presented in FIGS. 3*a* and 3*b* present electro-optics curves, sometime referred to as voltage-transfer curves, for the same voltages delivered across three slightly different cell gaps, corresponding to 3.8 micrometers (μm), 4.0 μm and 4.2 μm. In FIG. 3A, curves 20, 22, and 24 correspond to 3.8 micrometers (μm), 4.0 μm and 4.2 μm. In FIG. 3B, curves 26, 28, and 30 correspond to 3.8 micrometers (μm), 4.0 μm and 4.2 μm. While these cell gaps were selected for this nonlimiting example, they are only representative of typical data.

The nematic liquid crystal responds to the magnitude of the field acting on it taking into account the distance between the field electrodes. Thus a given voltage acting through the thinner cell gap of 3.8 μm will have a given effect on the reorientation of the liquid crystal molecules at lower voltages and therefore the liquid crystal shifts to its most optically efficient mode at a lower RMS voltage than for the thicker cell gap points. By the same token a given voltage operating through the thicker 4.2 μm cell gap will have less of an effect at a given voltage and therefore a higher RMS voltage will be required to achieve peak optical efficiency. These differences in the three curves are the starting point for detailed discussions of the present invention.

Figure 4:
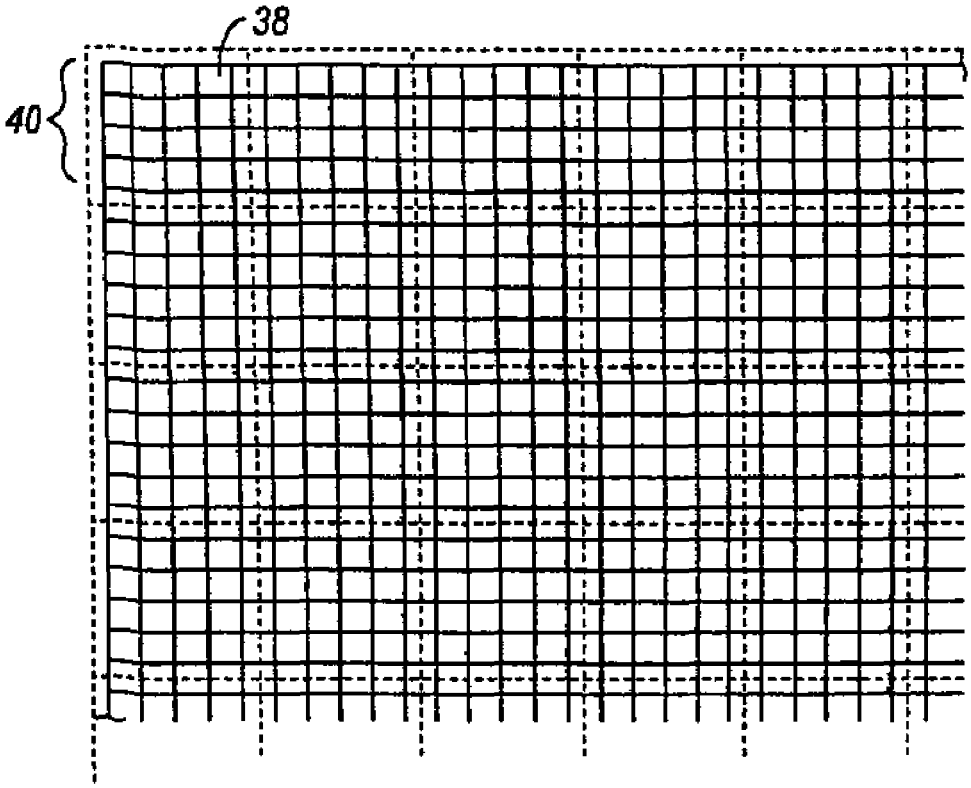
FIG. 4 depicts the overlay of a CCD camera collecting device pixel structure over the pixel structure of an LCOS microdisplay.

FIG. 4 depicts one embodiment of a method of collecting uniformity data on a panel. Although not limited to the following, an automated device of the type previously described is manufactured by Westar and may be used to position a device such as but not limited to a CCD camera, a digital camera, or other optical output measurement device, and data is collected. It should be understood that a variety of optical detection systems may be used to collect data on the output from the display. FIG. 4 depicts one embodiment of a field correspondence between the camera collecting the data and the pixel array of the microdisplay. FIG. 4 depicts the pixel array of a display such as, but not limited to a microdisplay, in solid lines and the pixel array of the CCD camera in dashed lines. In the embodiment shown in FIG. 4, each pixel of the CCD camera covers approximately 25 pixels 38 on the microdisplay and these pixels define a cell 40. In one embodiment, the actual ratio to be used is arbitrary but may be selected to collect a large number of microdisplay pixels in one CCD pixel to reduce the processing bandwidth required to reduce the data to the required form. The number of pixels 38 per cell 40 may be predetermined, selectable, or any combination of the above. In some embodiments, the CCD camera could be in one to one correspondence with the microdisplay, although this would require significantly greater processing bandwidth. The former case does not significantly reduce the effectiveness of the fix because most nonuniformity effects span hundreds of pixels on the array.

Figure 5:
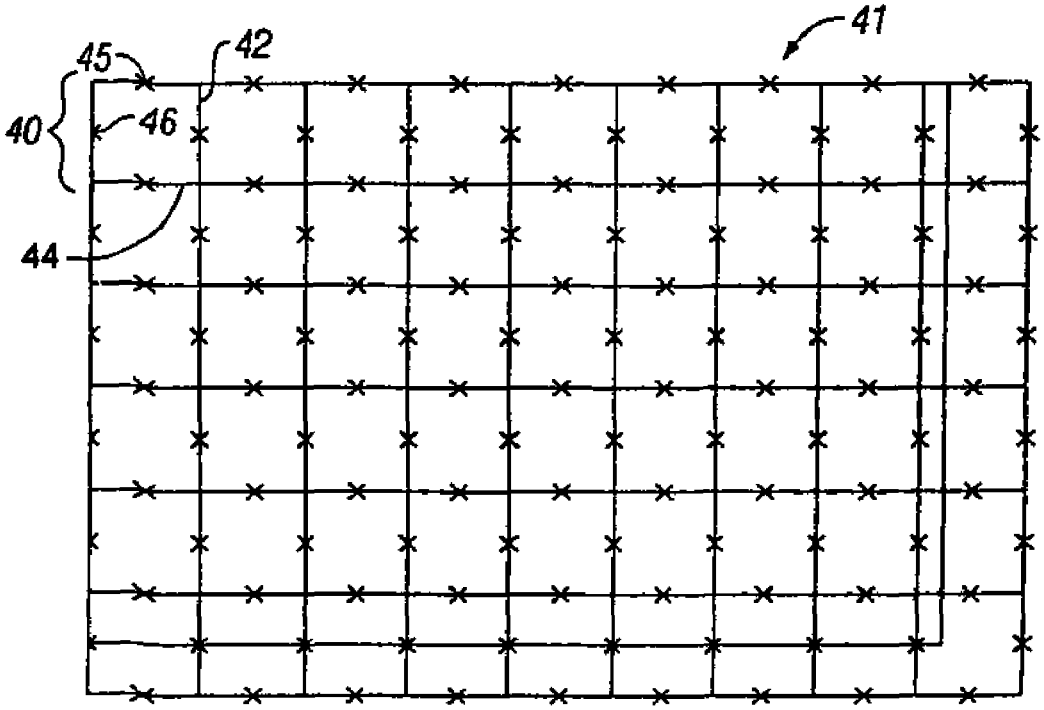
FIG. 5 depicts the correspondence between the horizontal and vertical correction tables and the physical structure of the array.

FIG. 5 depicts the correspondence between the tables of correctional data calculated from the data collected using the technique of FIG. 4 and the physical pixel array of the display 41. In the embodiment of FIG. 5, the figure shows grid lines 42 and 44 placed at 64 pixel intervals along the vertical and horizontal dimensions of the array. The tables are described in more detail with regards to FIG. 6. A database may provide separate data tables (see FIG. 6) which may be kept for horizontal correctional data and for vertical correctional data. The horizontal correctional data in this nonlimiting example is used to represent the notional uniformity along lines at either side of a 64 by 64 pixel array. Correspondingly the vertical correctional data in this nonlimiting example is used to represent the notional uniformity along lines at the top and the bottom of the same 64 by 64 array. The details will be explained in greater detail below.

In the present embodiment, the correction for a given point on the display 41 is determined by making a weighted interpolation between the horizontal correction factors for the cell 40 and between the vertical correction factors for the same cell and then averaging the two correction factors. At the bottom and right ends of the grid, the grid structure defined by lines 42 and 44 is extended outside the physical structure of the microdisplay. This is done to permit the use of the same calculation algorithm within the microdisplay controller structure. Because there are no physical elements present from which to collect data the values for these hypothetical points are determined by common curve fitting techniques to insure that the calculations are correct for the points where physical data is present. For each cell 40, horizontal calibration points 45 and vertical calibration points 46 may be used to determine the correction factor for each cell 40.

Referring now to FIG. 6, one embodiment of the table structure of the horizontal and vertical correction files is depicted. Although other numbers of entries may be used, each correction point in this embodiment contains two entries. The first entry (ofst x-y) is termed the "offset". This value represents the offset value for the electro-optic (voltage-transfer) curve of the referenced area from the "reference" electro-optic curve for the device. The reference curve is a nominal value that can be selected according to a number of readily obvious criteria. The second point (sip x-y) is termed the "slope" value. The slope in this instance is a calculated value that is used to redistribute the gray scale values uniformly within the available gray range. This is desired to preserve some measure of gray scale allocation across the entire range of available value. Without it all bits at the high end of the scale may end up being represented by the same value. The unit of dimension for offset values is the number of bits to be offset. The slope value is a dimensionless ratio.

In this embodiment, each point in the correction table is associated with a boundary edge of a given block of pixels. For example, the first table entry in the vertical table found in FIG. 6 "V(Ofst 1-1, Slp1-1)" is associated with the top edge of the upper left block depicted in FIG. 5 while table entry "V(Ofst 2-1, Slp 2-1)" is associated with the bottom edge of that same block as well as the top edge of the block below. The horizontal values are similarly associated with the left and right hand edges of given blocks.

Figure 7:
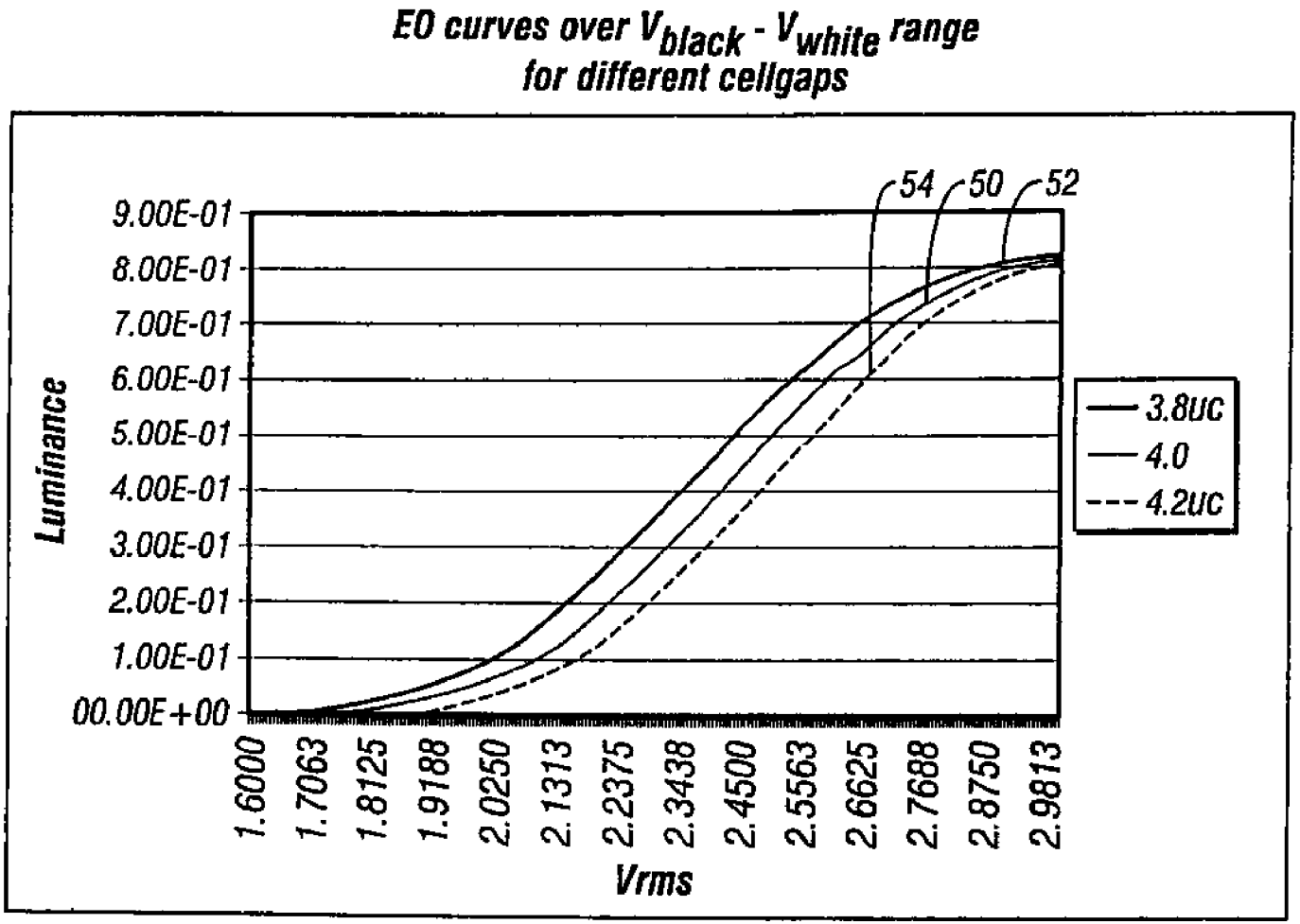
FIG. 7 depicts a specific point on the voltage transfer curves of FIG. 3*b*.

FIG. 7 depicts a nonlimiting example of how specific table entries may be calculated. In this figure the central curve 50 (associated with the 4.0 μm cell gap) is considered to be the nominal value. It need not be the central value in practice. The shapes of the three curves 50, 52, and 54 are typical in that under similar conditions the curves are parallel and quite similar in most aspects of performance. While the horizontal scale in 7 is RMS volts, there are sets of bit values that can be mapped to discrete voltage points on the horizontal scale. The relationship between the bit values and the RMS voltage values is normally a monotonically increasing one with the central regions approximately linear. The goal of the offset algorithm is to create a mapping from the bit values of the nominal curve to a corresponding bit value for the points with variant cell gaps that creates the same level of intensity in the display. Application of this mapping to the input data thus creates a new set of drive data that compensates for the non-uniformities that would otherwise be observed. Another goal of the offset algorithm is to preserve the top end gray scale range of the display. Without the use of the slope factor the gray scale voltages at the top end of the scale may be compressed. By application of the slope scaling factor gray scale differences at the extremes are preserved with some loss of intermediate resolution.

Again referring to 7, the offset value between curve 50 and the thinner cell gap curve 52 may be considered to be (for purposes of example) 16 bits. Similarly the offset value between curve 50 and the thicker cell gap curve 54 may be considered to be (for purposes of example) also 16 bits.

An offset to the left is considered to have a negative sign while an offset to the right is considered to have a positive sign. This convention is arbitrary and may be reversed with suitable reordering of the associated calculations without affecting this invention. At an arbitrary point on curve 50 the value associated with a certain intensity I1 is 32. The bit level associated with that same intensity I1 on curve 52 is 16 and on curve 54 is 48. The offset associated with curve 52 is thus −16 and with curve 54 is similarly +16. In a typical calculation the bit value for a point with V-T curve similar to that of curve 54 is determined by adding the offset value to the bit value of the nominal curve. Similarly in a calculation of the bit value for a point with V-T curve similar to that of curve 52 the new value is determined by adding the (negative) offset value to the bit value of the nominal curve.

The calculation of the slope value depends on which side of the nominal curve the particular point falls. In the case where the V-T curve associated with a point is similar to curve 54, the higher bit points yield values above 255. For example, if 253 is the bit value for the data for a point, then the calculated value becomes 253+16 or 269. In similar manner, when the offset is +16, any bit value of 250 or above will be represented by a number at 255 or above after the application of the offset to the data stream. This is problematic because many micro-display controller will truncate this value since it exceeds the nominal gray scale limit for input data. The result would be a loss of gray scale differentiation at the high end that may be as objectionable as the original nonuniformity. The slope factor is used to correct for this error.

Slope is calculated by dividing the offset factor by the gray scale range in those cases where uniformity corrected gray scale bit levels exceed 255. In the present example the slope is calculated to be 16/256 or 1/16. This is the value that is stored in the correction table for later use during system operation.

As an early example of the final calculation, the slope is multiplied by the calculated bit value and the product is subtracted from the calculated bit value to yield the slope corrected bit value. In the case of the 253 example above the calculations run as follows. First as noted above the sum of 253 and 16 is 269. This becomes the offset corrected bit value. Then 269 is divided by 16 to yield 16.8 which can be rounded to 17. The value 17 is then subtracted from 269 to yield 252.

In the case where the offset value is −16 the peak gray scale value needed at the high end is 255−16 or 243. While scale-back is not needed in this case to preserve gray scale the slop correction is still required to insure that maximum brightness is reached for that pixel area. The formula is applied in the same manner as before. Because the arithmetic operation perform is subtraction and because the slope will have a negative sign, the result of the operations is an increase in the value of the bit value at the higher end of the scale.

It is important to note that at the low end of the gray scale the negative offset value can yield negative gray scale values when the gray scale number is less than the absolute value of the offset value. In those cases the displayed value can be reset to 0. This may become objectionable in cases where the entire image is near the low end of the range. A scale calculation can be performed similar to the scale back operation if desired. The criteria for when to do this will be developed shortly.

A typical interpolation in a given block is accomplished algorithmically is follow. Taking the example from the upper left block, assume the point has horizontal location x and vertical location y. The weighting formula in the case where the block is 64 pixels wide and 64 pixels tall would be:

$$\text{Offset}(x,y)=[(((64-x)/64)*H(Ofst\ 1-1))+((x/64)*H(Ofst\ 1-2)))/2+(((64-y)/64)*V(Ofst\ 1-1)+((y/64)*V(Ofst\ 1-2)))/2]/2$$

Thus the offset is calculated as the average of the weighted average of the two horizontal offset factors and the weighted average of the two vertical offset values.

A similar calculation for the slope factors exists, where $$\text{Slope}\ (x,y)=[(((64-x)/64)*H(Slpt\ 1-1))+((x/64)*H(Slp\ 1-2)))/2+(((64-y)/64)*V(Slp\ 1-1)+((y/64)*V(Slp\ 1-2)))/2]/2$$

It is immediately obvious to those skilled in the art that many variations to this approach may be used. For example, different slope values may be used above and below the nominal mid point of the part. Similarly a low end slope value can be determined to preserve low end gray scale at the bottom end of the curve. Alternatively the offset and slope may be applied to an arbitrary number of segments. All of these have been considered by the inventor of this invention and are included without limitation in the present invention. A controller or other processor may be used to apply the above equations to the data collected by the CCD camera or other optical input device. The same or typically separate controller applies this correction data to image data coming to the display when the display is in use.

In embodiments of the present invention, the following may also apply.

For wider cell gap:

$$\text{Pixel}_{adjusted}=(\text{Pixel}_{original}+\text{offset})*(1-\text{slope})$$

For thinner cell gap:

$$\text{Pixel}_{adjusted}=(\text{Pixel}_{original}-\text{offset})*(1+\text{slope})$$

Two compensation parameters may be used for each pixel. As a nonlimiting example, each pixel may have a weighted compensation information with the following:

Offset:
- 7-bit (signed)
- range: −64 to 63

Slope:
- 7-bit (signed)
- range: −(~¼) to +(~¼)

In one embodiment, adjustment parameters are stored in two calibration tables as seen in FIG. 6. It should be understood that a database may also be configured to store the vertical and horizontal correction data in a single table, multiple table, or in any combination of the above. In the present embodiment, vertical table may store both offset and slope parameters in the vertical direction. Horizontal table may store both offset and slope parameters in the horizontal direction. In one nonlimiting example, the width of both tables are 14 bits (7-bit offset; 7-bit slope). The depth of both tables are 448 entries. In one embodiment, it takes about 390 entries to support SXGA+ resolution. In another embodiment, it takes about 527 entries to support HDTV resolution.

In one embodiment, the following formula may be used for pixel compensation on the display. With the slope and offset information above for each cell, the correction for each pixel may also be determined. Specifically, as seen in the nonlimiting example of FIG. 5, the display 41 may be divided into 64-pixel by 64-pixel domains or cells 40. Domains or cells 40 can extend beyond actual imager pixel area on display 41. In the present embodiment, each domain may have two sets of compensation parameters: one vertical set and one horizontal set. In this nonlimiting example, each set has a 7-bit offset and a 7-bit slope parameters. Each pixel data may keep track of its physical pixel location in the display 41 and use the parameters within that domain or cell 40 to arrive at a correction information for that pixel. The following equations may be used to determine the correction data for each pixel.

$$\text{PixelOffset}_{hori}=\text{DomainOffset}_{Left}*(1-x/64)+\text{DomainOffset}_{Right}*x/64$$

$$\text{PixelOffset}_{vert}=\text{DomainOffset}_{Top}*(1-y/64)+\text{DomainOffset}_{Bottom}*y/64$$

$$\text{PixelOffset}=\text{PixelOffset}_{hori}+\text{PixelOffset}_{vert}$$

$$\text{PixelSlope}_{hori}=\text{DomainSlopeLeft}*(1-x/64)+\text{DomainSlopeRight}*x/64$$

$$\text{PixelSlope}_{vert}=\text{DomainSlopeTop}*(1-y/64)+\text{DomainSlopeBottom}*y/64$$

$$\text{PixelSlope}=\text{PixelSlope}_{hori}+\text{PixelSlope}_{vert}$$

$$\text{Pixeladjusted}=(\text{Pixel}_{original}+\text{PixelOffset})*(1-\text{PixelSlope})$$

Figure 8:
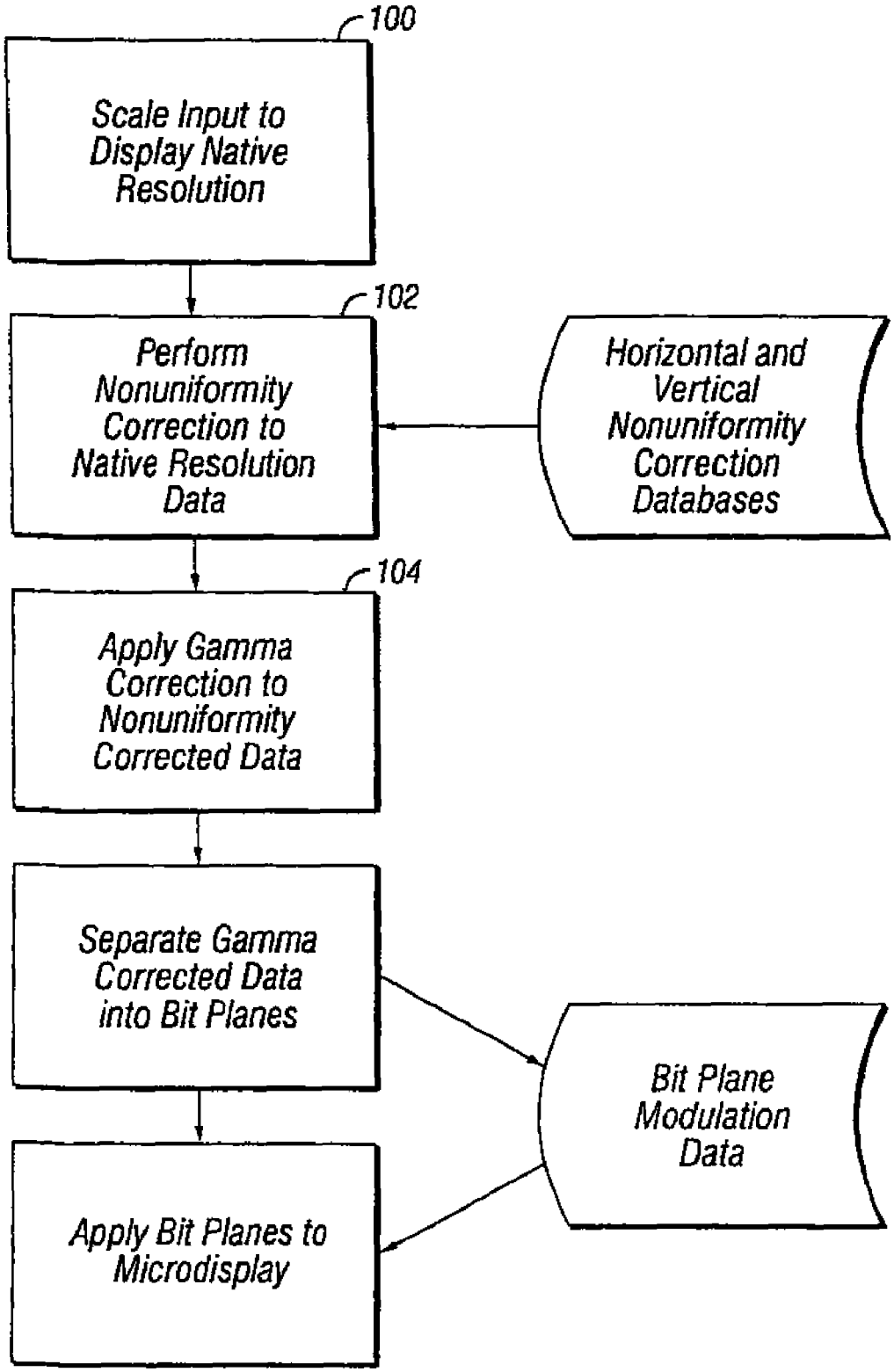
FIG. 8 depicts a typical flow diagram for data through a microdisplay controller after the present invention.

Referring now to the embodiment shown in FIG. 8, the application of correction data to image data going to the display 41 will now be described. The point at which the calculation is applied is one point of consideration. The assumption in the foregoing text has been that the calculation and correction at step 102 takes place after the data has been scaled to the resolution of the display 41 at step 100 but before gamma correction has been applied at step 104. It should be understood, however, that these steps may be rearranged without departing from the spirit of the present invention. As a nonlimiting example, a modified version of the present invention can be made to apply both gamma and nonuniformity correction 104 and 102 to a data stream at the same time. Similarly the same methods can be applied to the data after gamma correction has been applied. In an alternative embodiment the gamma correction can be implicit in the data collected by the measurement system.

While the invention has been described and illustrated with reference to certain particular embodiments thereof, those skilled in the art will appreciate that various adaptations, changes, modifications, substitutions, deletions, or additions of procedures and protocols may be made without departing from the spirit and scope of the invention. A number of different preferences, options, embodiment, and features have been given above, and following any one of these may results in an embodiment of this invention that is more presently preferred than a embodiment in which that particular preference is not followed. These preferences, options, embodiment, and features may be generally independent, and additive; and following more than one of these preferences may result in a more presently preferred embodiment than one in which fewer of the preferences are followed.

Any of the embodiments of the invention may be modified to include any of the features described above or feature incorporated by reference herein. For example, the present invention is not limited to microdisplays or liquid crystal on silicon displays. The correction may occur prior to scaling the input image data to a native resolution. The cell sizes used for the correction tables may vary beyond the 64 pixel by 64 pixel size described herein. As nonlimiting examples, the size could be 32×32, 8×8, or any other size desired. The cells may be rectangular or other shaped, so long as the correction data may be determined for the pixels in the cell. Some embodiments may have entries that only correct for voltage or gray scale and not both. Some embodiments may only have correction data for those areas on the display which have nonuniformities outside a desired range, thus reduce the amount of memory used to store correction information since the table stores correction for only for those areas that need to have nonuniformity corrected. The correction data is specific for each display and that information may be stored in a database that in a controller shipped with the display, stored on a storage or memory device provided with the display, emailed or otherwise transferred separately from the display (but with some identifier to indicate which display corresponds to the correction data), or the like.

Expected variations or differences in the results are contemplated in accordance with the objects and practices of the present invention. It is intended, therefore, that the invention be defined by the scope of the claims which follow and that such claims be interpreted as broadly as is reasonable.

What is claimed is:

1. A method for compensating for output nonuniformity on a display, the method comprising:

providing data for compensation along vertical axes of the display and data for compensation along horizontal axes of the display, wherein components of the compensation include a linear offset factor to correct data for nonuniformity and a slope factor which permits gray scale information to be recovered at points near the limits of the gray scale range; and adjusting luminous output at a given point on the display based upon interpolation of the components of the compensation, wherein the offset factor maps bit values of a nominal voltage transfer curve for the display to a corresponding bit value for points in the display with variant cell gaps so that the points with variant cell gaps produce a desired intensity in the display.

2. The method of claim 1, further comprising:

characterizing the display to obtain optical information used in determining the data for compensating along the vertical and horizontal axes.

3. The method of claim 2, wherein characterizing the display comprises using a optical detector.

4. The method of claim 2, wherein characterizing the display comprises using a digital camera.

5. The method of claim 2, wherein characterizing the display comprises using a CCD camera.

6. The method of claim 1, wherein said display is viewed as having a plurality of cells each defined by a plurality of pixels, each of said pixels having a weighted average solution based on location of the pixel in the cell.

7. The method of claim 1, further comprising:

interpolating the correction data for each pixel in response to where the pixel is located in said cell.

8. A method for compensating for output nonuniformity on a display, the method comprising:

providing data for compensation along vertical axes of the display and data for compensation along horizontal axes of the display, wherein components of the compensation include a linear offset factor to correct data for nonuniformity and a slope factor which permits gray scale information to be recovered at points near the limits of the gray scale range; and adjusting luminous output at a given point on the display by the slope factor based upon interpolation of the components of the compensation so that the luminous output does not exceed a nominal gray scale limit of the display.

9. The method of claim 1, wherein the display comprises a microdisplay.

10. The method of claim 8, further comprising:

characterizing the display to obtain optical information used in determining the data for compensating along the vertical and horizontal axes.

11. The method of claim 8, further comprising:

interpolating the correction data for each pixel in response to where the pixel is located in said cell.

12. The method of claim 8, wherein the display comprises a microdisplay.

13. The method of claim 8, wherein said display is viewed as having a plurality of cells each defined by a plurality of pixels, each of said pixels having a weighted average solution based on location of the pixel in the cell.

14. The method of claim 10, wherein characterizing the display comprises using a optical detector.

15. The method of claim 10, wherein characterizing the display comprises using a digital camera.

16. The method of claim 10, wherein characterizing the display comprises using a CCD camera.

17. A display driver comprising:

a controller adapted to adjust luminous output at a given point on a display, wherein the adjusting is based upon data for compensation along vertical axes of the display and data for compensation along horizontal axes of the display, wherein components of the compensation include a linear offset factor to correct data for nonuniformity and a slope factor which permits gray scale information to be recovered at points near the limits of the gray scale range; and a driver adapted to adjust the luminous output at the given point on the display, wherein the offset factor maps bit values of a nominal voltage transfer curve for the display to a corresponding bit value for points in the display with variant cell gaps so that the points with variant cell gaps produce a desired intensity in the display.

18. The driver of claim 17, wherein adjusting luminous output is based upon interpolation of the components of the compensation.

19. A display driver comprising:

a controller adapted to adjust luminous output at a given point on a display, wherein the adjusting is based upon data for compensation along vertical axes of the display and data for compensation along horizontal axes of the display, wherein components of the compensation include a linear offset factor to correct data for nonuniformity and a slope factor which permits gray scale information to be recovered at points near the limits of the gray scale range; and a driver adapted to adjust the luminous output at the given point on the display by the slope factor so that the luminous output does not exceed a nominal gray scale limit of the display.

20. The display driver of claim 19, wherein the driver adjusts the luminous output based upon interpolation of the components of the compensation.

21. A display driver comprising:

a memory adapted to store data for compensation along vertical axes of a display and data for compensation along horizontal axes of the display, wherein components of the compensation include a linear offset factor to correct data for nonuniformity and a slope factor which permits gray scale information to be recovered at points near the limits of the gray scale range; and a controller adapted to adjust luminous output at a given point on a display, wherein the adjusting is based upon interpolation of the components of the compensation, wherein the offset factor maps bit values of a nominal voltage transfer curve for the display to a corresponding bit value for points in the display with variant cell gaps so that the points with variant cell gaps produce a desired intensity in the display.

22. A display driver comprising:

a memory adapted to store data for compensation along vertical axes of a display and data for compensation along horizontal axes of the display, wherein components of the compensation include a linear offset factor to correct data for nonuniformity and a slope factor which permits gray scale information to be recovered at points near the limits of the gray scale range; and a controller adapted to adjust luminous output at a given point on a display by the slope factor, wherein the adjusting is based upon interpolation of the components of the compensation so that the luminous does not exceed a nominal gray scale limit of the display.

* * * * *